United States Patent [19]

Codecasa

[11] 4,252,004

[45] Feb. 24, 1981

[54] WASH UNIT FOR DRY CLEANSERS AND THE LIKE

[75] Inventor: Vittorio Codecasa, Milan, Italy

[73] Assignee: E. Mottana S.p.A., Italy

[21] Appl. No.: 93,316

[22] Filed: Nov. 13, 1979

[51] Int. Cl.[3] ..... D06F 21/04

[52] U.S. Cl. ..... 68/58; 68/140

[58] Field of Search ..... 68/58, 139, 140, 148, 68/152; 134/139, 141; 366/280

[56] References Cited

U.S. PATENT DOCUMENTS 1,586,022 5/1926 Barker ..... 68/58

1,767,615 6/1930 Rabinowitz ..... 68/58 X 2,816,429 12/1957 Kurlancheek ..... 68/152 X

FOREIGN PATENT DOCUMENTS 401943 11/1933 United Kingdom ..... 68/58

*Primary Examiner*—Philip R. Coe

*Attorney, Agent, or Firm*—Karl W. Flocks

[57] ABSTRACT

This invention relates to a wash unit for dry cleaners and the like. According to the invention the wash unit includes a drum which is rotated by utilizing part of the energy of the circulating water, which passes through the outer perforated wall of the drum.

3 Claims, 2 Drawing Figures

WASH UNIT FOR DRY CLEANSERS AND THE LIKE

Wash units are used in the dry cleaning field which consist essentially of a tank containing a perforated drum into which the fabric is placed. This drum is rotated by a variable speed motor. The fabric is washed in such units by the forced circulation of the tank liquid through the drum walls and the fabric weave by means of a pump disposed inside the drum, which draws water from the inside of the drum and discharges it into the tank.

One of the major drawbacks of this type of unit is that the drum speed, which is adjusted at the beginning of the process according to the type of fabric and type of process to be carried out, does not automatically adapt itself to the inevitable variations deriving from the intrinsic characteristics of the material treated.

In this respect, the characteristics and behaviour of the natural or synthetic fibres with which the fabric or knitwear pieces treated in such tanks at a generally high temperature are formed, can vary from one region to another in the same piece, particularly when the fibres are natural fibres and therefore live. This means that the drum sometimes pulls too fiercely with the risk of causing the piece to contract transversely, and sometimes pulls too weakly so that there is imperfect adherence to the drum and therefore imperfect washing.

With the present invention all the aforesaid drawbacks are obviated by providing automatic control of the drum speed determined by the fabric itself, in the sense that if the fabric tends to pull (as one region becomes more contracted than the previous one), this tension directly causes the drum rotation to slow down, and likewise if the pull reduces then the drum speed increases.

This is attained as a consequence of the present invention in a simple and economical manner, by dispensing with the motor which rotates the drum, and using as its rotational drive means the force produced by the velocity of the water drawn in by the pump, in other words by using part of the energy of the water circulated by the pump.

It will be apparent that by adjusting the drum speed in its empty state to a speed which is slightly higher than the average speed necessary for normal operation, then as the drum is driven by a resilient motor, i.e. a fluid in free movement, it is necessary only to adjust the force of rotation of the drum for a slight tension in the fabric to reduce the speed without the fabric itself undergoing any excessive pulling (which would lead to transverse contraction of the fabric). This latter does in fact happen in the known art, where the drum is rotated by a motor and a reduction gear, which rigidly compel it to rotate at a determined speed.

The invention will be more apparent from the description of the embodiment given by way of non-limiting example with reference to the two accompanying drawings in which.

Figure 1:
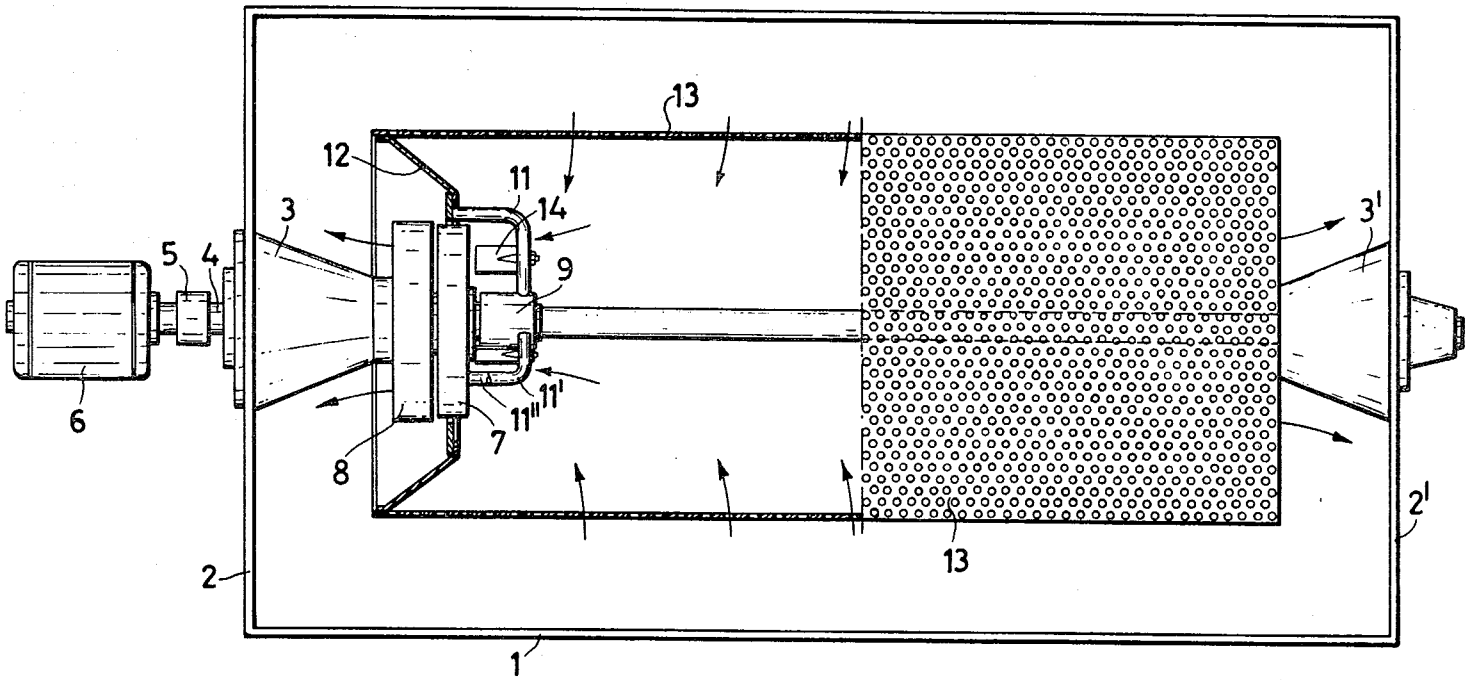
FIG. 1 is a diagrammatic part plan view and part section of the wash unit
Figure 2:
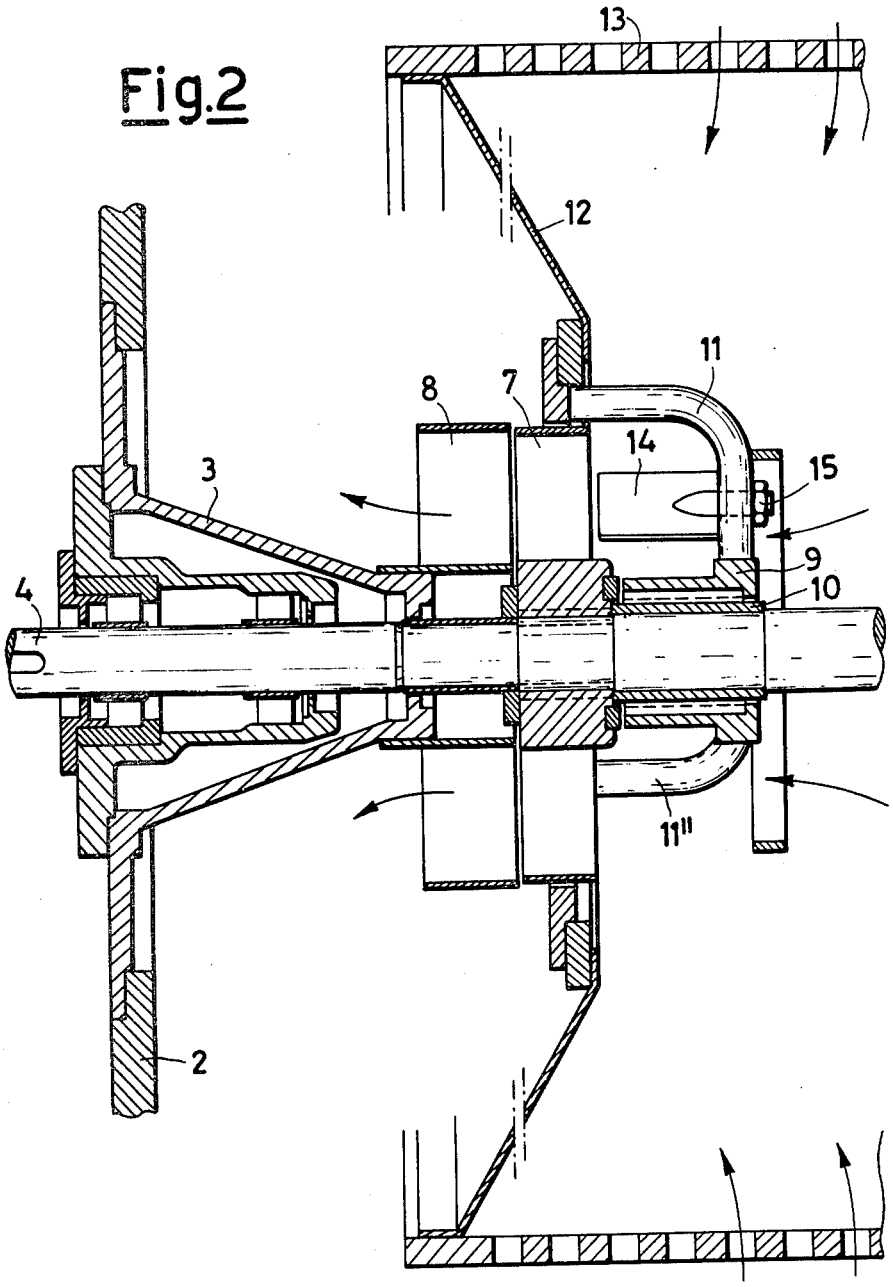
FIG. 2 is a vertical section through the section part of FIG. 1 to a greater scale in order to emphasise certain details thereof.

With reference to FIGS. 1 and 2, the wash unit according to the invention is constituted by a tank of suitable material 1, generally stainless steel. The minor walls 2 and 2' of the tank each centrally comprise an aperture, to each of which are fitted the supports 3 and 3', each of which supports a pump and the other mechanisms which complete the invention.

Each tank therefore comprises two pumps and the relative mechanisms connected thereto.

FIG. 1 shows diagrammatically only one pump and its relative mechanisms, namely those fitted to the wall 2, in that those on the wall 2' do not appear on the drawing as they are hidden by the drum.

The description given hereinafter, which refers in particular to FIG. 2, relates to only one of the two groups, but it also applies to the other group as they are identical in terms of type, dimensions and characteristics.

The shaft 4 is rotatably inserted through the two supports 3 and 3', and is connected by way of the coupling 5 to the motor 6 which rotates it during operation.

Both the shaft and motor simultaneously operate the two groups.

With reference to FIG. 2, the group is constituted according to the invention by a pump impeller 7 mounted rigidly on the shaft 4, the diffuser 8 fixed on to the support 3 and the cylindrical support 9 idly mounted on the shaft by way of the bearing 10 of suitable material for withstanding attack by the chemical substances contained in the tank.

The support 9 is therefore not rotated together with the shaft 4 when the shaft is in motion.

Three arms 11, 11', 11'' (this latter not shown on the figure) are connected to the support 9.

To each of these arms there is connected a cone frustum disc constituting the end piece 12 of the perforated cylinder 13, which forms the machine drum to which the fabric to be treated adheres.

Within the three arms 11, 11', 11'' are fitted three blades 14 which can be inclined in order to suitably position them, and then locked in the required position by bolts 15.

Operation is as follows. On starting the motor, the shaft 4 rotates and thus drives the respective impellers 7 of the two pumps mounted on it (one of the impellers will have its blades inclined towards the right and the other towards the left in order to create internal suction).

The effect of this is to create a reduced pressure at the inlet of each impeller such that the liquid contained in the drum is drawn by the impeller and delivered at speed through the diffuser 8 towards that region of the tank not occupied by the drum, thus generating a liquid flow from the inside to the outside of the drum through the two tank end pieces. As a result of this flow, water is returned into the drum through the perforated drum walls and consequently through the weave of the fabric disposed on the drum.

The liquid flows substantially from the outside of the drum through its wall towards its inside and from there through the aperture in the two end pieces towards the corresponding tank regions on the outside of the drum, by way of the pump impeller which gives the water the required kinetic energy.

Any other path is precluded because of the presence of the end pieces 12, which are non-perforated. The flow follows the arrows shown in FIGS. 1 and 2.

If the blades 14 were not mounted on the arms 11, then the drum 13 would remain at rest as the support 9 is idle on the shaft. However, the blades 14 mounted on the arms 9 are struck by the water drawn by the impeller, so that a transverse force is generated which acts on the blades to cause the drum to rotate.

By varying the inclination of the blades, the extent of this force and consequently the drum speed vary, as a function of the external force which opposes motion (in the present case the force necessary for dragging the fabric wound about the drum).

It is apparent that in order to obtain automatic control of said speed, it is necessary only to adjust the inclination of the blades such that the drum initially has a rotational speed which is only slightly higher than that necessary for normal operation, by which means the force necessary for reducing its speed will be less than that required to cause the fabric to slide transversely on the drum and thus contract it.

The described example is given by way of non-limiting embodiment only, and different equivalent mechanical means can be used for attaining the invention, without leaving the scope of the inventive idea.

I claim:

1. A wash unit for dry cleaners and the like comprising in combination:

a. a tank;

b. a rotatable drum enclosed within said tank;

c. a shaft extending through said tank and said drum;

d. said tank having opposite end walls each of which includes means supporting said shaft for rotation on said tank;

e. said drum having radially inwardly extending members at opposite ends thereof;

f. means interconnecting each of said radially inwardly extending members to a support member provided with bearing means rotatably supporting said drum on said shaft;

g. said interconnecting means also carrying blade members reacting to drive from cleaning fluid or liquid flow;

h. means for driving said shaft;

i. a pump impeller element rigidly mounted on said shaft adjacent at least one end of said drum and some of said blade members; and j. said drum having a perforated circumferential surface whereby during operation of said wash unit rotation of said pump impeller element by said driving means through said shaft will effect flow of cleaning fluid or liquid radially inwardly of said drum from said tank, through said perforated surface, axially outwardly of said drum, and against said some of said blade members to thereby supply a rotary force component to said drum.

2. A wash unit as claimed in claim 1 wherein a second pump impeller element is rigidly mounted on said shaft adjacent the second end of said drum and other of said blade members whereby a second rotary force component may be supplied to said drum by cleaning fluid or liquid and wherein said pump impeller element adjacent to one end of said drum is oriented so as to be in opposition to the orientation of said pump impeller element adjacent the other end of said drum to thereby pump cleaning fluid or liquid to the ends of said drum.

3. A wash unit as claimed in claim 1 or claim 2, wherein said blades are positionable so as to vary the thrust action of the water and thus the drum speed.

* * * * *